US005603307A

United States Patent [19]

Morita et al.

[11] Patent Number: 5,603,307

[45] Date of Patent: Feb. 18, 1997

[54] IGNITION COIL FOR INTERNAL COMBUSTION ENGINE

[75] Inventors: Shingo Morita; Mitsuru Koiwa, both of Tokyo, Japan

[73] Assignee: Mitsubishi Denki Kabushiki Kaisha, Tokyo, Japan

[21] Appl. No.: 582,437

[22] Filed: Jan. 3, 1996

[30] Foreign Application Priority Data

Apr. 3, 1995 [JP] Japan ..... 7-077931

[51] Int. Cl.[6] ..... F02P 3/04; F02P 15/00; H01F 38/12

[52] U.S. Cl. ..... 123/633; 123/634

[58] Field of Search ..... 123/633, 634, 123/651, 652

[56] References Cited

U.S. PATENT DOCUMENTS

| | | | |
|---|---|---|---|
| 4,186,712 | 2/1980 | Fitzner et al. | 123/633 |
| 4,191,155 | 3/1980 | Nishio et al. | 123/633 |
| 4,451,764 | 5/1984 | Gerry | 123/633 X |
| 4,774,914 | 10/1988 | Ward | 123/633 X |

FOREIGN PATENT DOCUMENTS

| | | | |
|---|---|---|---|
| 53-67033 | 6/1978 | Japan | 123/633 |
| 59-34485 | 2/1984 | Japan | 123/633 |

*Primary Examiner*—Tony M. Argenbright
*Attorney, Agent, or Firm*—Sughrue, Mion, Zinn, Macpeak & Seas

[57] ABSTRACT

An ignition coil for an internal combustion engine to suppress the superposition of a noise signal caused by a capacitive discharge current at an ignition plug to thereby prevent the faulty operation of other circuit devices. The ignition coil has first and second non-magnetic bobbins into which a magnetic core 3 is inserted, a primary coil (1) wire wound around the first bobbin, a secondary coil (2) wire wound around the second bobbin, an interrupting circuit 7 connected to one end of the primary coil for interrupting a primary current i1 flowing to the primary coil, and an ignition plug 5 connected to one end of the secondary coil for generating a discharge spark by a secondary voltage V2 output from the secondary coil. A buffer coil 8 having an inductance which is much smaller than that of the primary or secondary coil is connected in series with one of them.

7 Claims, 11 Drawing Sheets

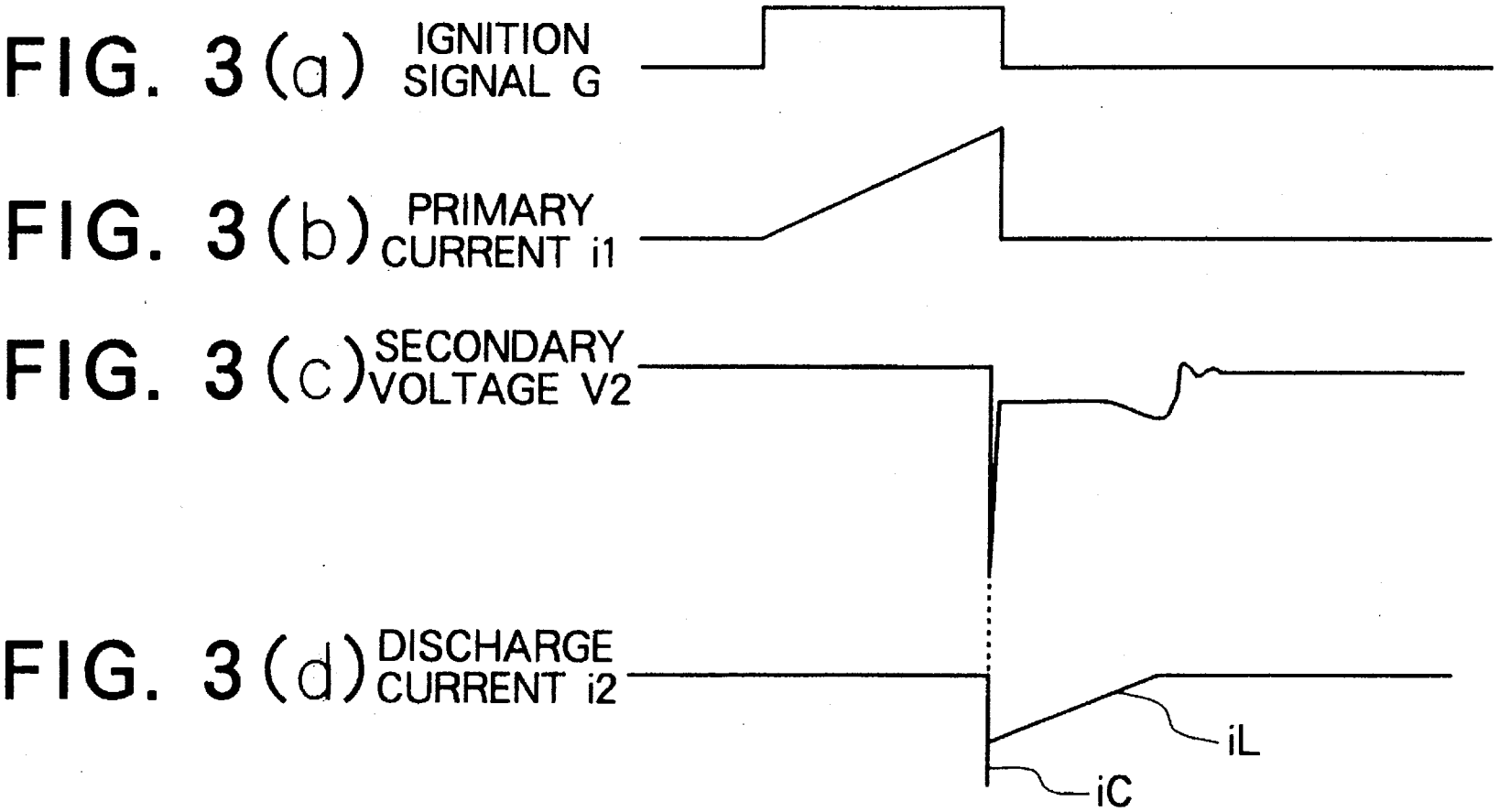
FIG. 3(a) IGNITION SIGNAL G
FIG. 3(b) PRIMARY CURRENT i1
FIG. 3(c) SECONDARY VOLTAGE V2
FIG. 3(d) DISCHARGE CURRENT i2

PRIOR ART
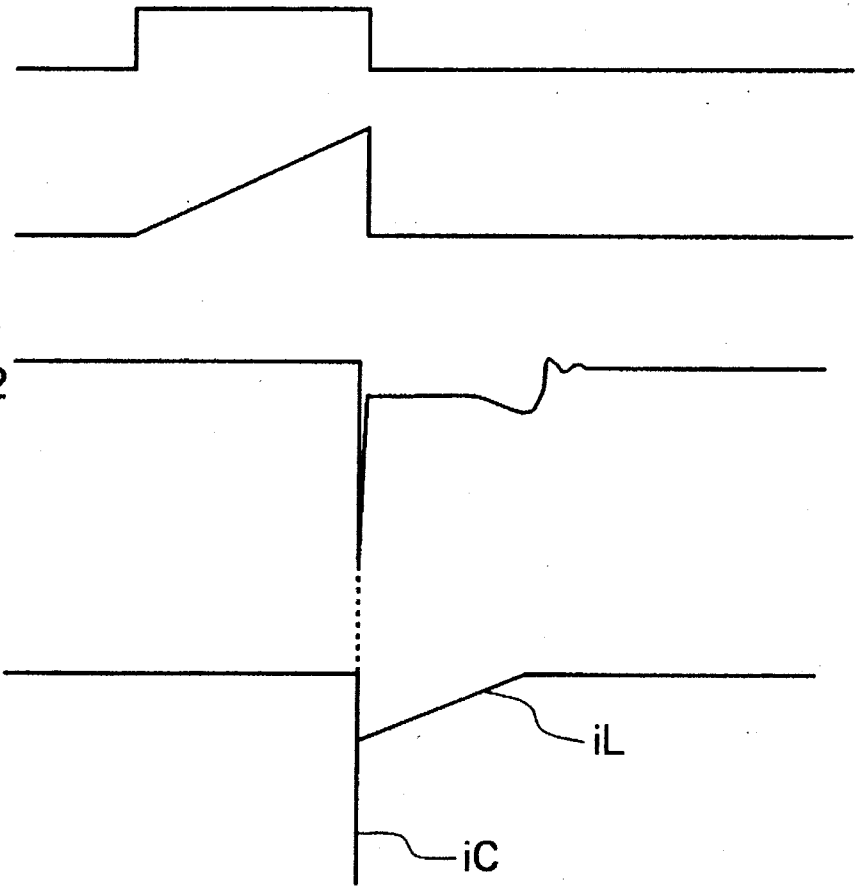
FIG. 11(a) IGNITION SIGNAL G
FIG. 11(b) PRIMARY CURRENT i1
FIG. 11(c) SECONDARY VOLTAGE V2
FIG. 11(d) DISCHARGE CURRENT i2

IGNITION COIL FOR INTERNAL COMBUSTION ENGINE

BACKGROUND OP THE INVENTION

1. Field of the Invention

The present invention relates to an ignition coil used in, for example, internal combustion engines such as automobile engines and the like, and more specifically, to an ignition coil for internal combustion engines which prevents faulty operation and the like of other circuit devices caused by the superposition of a capacitive discharge current (noise signal) flowing through an ignition plug.

2. Description of the Related Art

FIG. 9 is a arrangement diagram showing a conventional ignition coil for an internal combustion engine together with its associated circuits.

In FIG. 9, an ignition coil 4 is composed of a primary coil 1, a secondary coil 2 magnetically coupled with the primary coil 1 and a core 3 magnetically coupled with the primary coil 1 and secondary coil 2. A capacitive coupling component C4 is formed between the primary coil 1 and the secondary coil 2.

An ignition plug 5 is connected to one end of the secondary coil 2 to which a secondary voltage V2 output from the secondary coil 2 is applied. The ignition plug 5 is composed of a discharge gap having the other end grounded and arranged such that when the insulation thereof is broken, the ignition plug 5 generates discharge spark to flow discharge current i2.

A power transistor 6 has a collector connected to one end of the primary coil 1 and constitutes an interrupting circuit 7 for interrupting the feed of a primary current i1 flowing to the primary coil 1. The emitter of the power transistor 6 is grounded and a capacitive coupling component C7 is formed between the collector and the base thereof.

A battery power unit 9 is connected to the common input terminal of the ignition coil 4 and feeds the primary current i1 through the collector and emitter of the power transistor 6. An electronic control unit (ECU) 10 composed of a microcomputer applies an ignition signal G to the base of the power transistor 6 to feed and shut off a current to and from the power transistor 6.

FIG. 10 is a cross sectional view showing a specific structure of the ignition coil 4 in FIG. 9.

In FIG. 10, the primary coil 1 is composed of a wire wound around a first non-magnetic bobbin 11 and the secondary coil 2 is composed of a wire wound around a second non-magnetic bobbin 12. The primary coil 1 and first bobbin are inserted into the cavity of the second bobbin 2 and further the magnetic core 3 is inserted into the cavity of the first bobbin The common input terminal of the ignition coil 4 and the output terminal of the primary coil 1 are connected to a connector 14 through a terminal 13 shown by a single line for convenience (actually two lines) and electrically connected to the anode of the battery power unit 9 and the collector of the power transistor 6. Further, the one end of the secondary coil 2 or the output terminal of the ignition coil 4 is connected to the connector 14 through a terminal 23 and electrically connected to an external circuit or the ignition plug 5.

Next, operation of the conventional ignition coil for internal combustion engine shown in FIGS. 9 and 10 will be described with reference to the waveform diagram of FIG. 11. FIG. 11 shows the changes in time of the respective signal waveforms of the primary current i1 (FIG. 11*b*) flowing in response to the ignition signal G, (FIG. 11*a*) the secondary voltage V2 (FIG. 11*c*) generated in response to the feed and shut-off of the primary current i1, and the discharge current i2 (FIG. 11*d*) flowing in response to the secondary voltage V2. The discharge current i2 is composed of a capacitive discharge current iC and inductive discharge current iL.

First, the power transistor 6 constituting the interrupting circuit 7 is turned on in response to the ignition signal G (power transistor drive signal) of a high level output from the ECU 10 and starts flowing the primary current i1 to the primary coil 1.

The ignition signal G is turned to an L level when the primary current i1 reaches a sufficient current value at a timing corresponding to an ignition timing. With this operation, the power transistor 6 is turned off and the primary current i1 is shut off.

The shut-off of the primary current i1 causes magnetic energy accumulated in the core when the primary current i1 is fed, to be induced in the secondary coil 2 and output from the one end of the secondary coil 2 as the high-tension secondary voltage V2.

When the secondary voltage V2 reaches the breakdown voltage of the ignition plug 5, the ignition plug 5 starts discharging and the discharge current i2 starts to flow.

That is, the large capacitive discharge current iC instantly flows through the peripheral floating capacitive component (normally generated around the electrical line or terminal) of the ignition plug 5 and successively the inductive discharge current iL flows while being gradually reduced while the ignition plug 5 continuously discharges (the secondary voltage V2 is unchanged). With this operation, a discharge spark is generated at a predetermined ignition timing so that ignition is carried out by firing mixed gas in a cylinder.

At the time, the ignition plug 5 acts as a noise generating source and supplies a noise signal caused by the capacitive discharge current iC to the ignition coil 4 and a circuit including the ECU 10.

The noise signal influences the power transistor 6 and other circuit devices as, for example, radiant noise and radiation noise and increases faulty operation and radio noise.

A noise signal caused by the capacitive discharge current iC is superposed with the primary low-tension wiring of the ignition coil 4 through the magnetic coupling component and the capacitive coupling component C4 between the primary coil 1 and the secondary coil 2 and influences the power transistor 6 and the other circuit devices as line noise.

Further, the noise signal is superposed with the line of the ignition signal G through the capacitive coupling component C7 between the collector and base of the power transistor 6 and influences the other circuit devices including elements in the ECU 10.

In particular, although an arrangement in which the ignition coil 4 accommodates the power transistor 6 integrally therewith has been recently employed, since a wiring between the ignition coil 4 and the power transistor 6 is short in this case, a noise signal is less damped to increase influence caused by the superposition of noise as described above.

Likewise, although an arrangement in which the ignition plug 5 is directly connected to the ignition coil 4 has been employed to reduce the size of an ignition apparatus, since noise is not damped by a high-tension cable and the like in this case, influence due to the above superposition of noise is increased.

As described above, since the conventional ignition coil for an internal combustion engine does not take any measure against the capacitive discharge current iC generated at the beginning of the discharge current i2, the conventional ignition coil has a problem that the other circuit devices including the power transistor 6 and ECU 10 are liable to be faulty in operation by the influence of a superposed noise signal due to the capacitive discharge current iC.

SUMMARY OF THE INVENTION

An object of the present invention made to solve the above problem is to provide an ignition coil for an internal combustion engine which prevents the faulty operation and the like of other circuit devices by suppressing the superposition of a noise signal caused by the capacitive discharge current in an ignition plug with a circuit by disposing a buffer coil for a primary coil or secondary coil in series therewith.

An ignition coil for an internal combustion engine according to the present invention comprises first and second non-magnetic bobbins into which a magnetic core is inserted, a primary coil composed of a wire wound around the first bobbin, a secondary coil composed of a wire wound around the second bobbin, an interrupting circuit connected to one end of the primary coil for interrupting a primary current flowing to the primary coil, an ignition plug connected to one end of the secondary coil for generating discharge spark by a secondary voltage output from the secondary coil, and a buffer coil connected in series with the secondary coil and having an inductance smaller than that of the secondary coil.

In the present invention, since the buffer coil is connected in series with the secondary coil, a capacitive discharge current is suppressed to thereby suppress radiant noise, radiation noise and line noise so that faulty operation of other circuit devices can be prevented.

The coil for an internal combustion engine of the present invention is arranged such that the buffer coil is formed of the same winding as that of the secondary coil.

In the present invention, since the buffer coil is formed of the same winding as that of the secondary coil, an increase of the number of parts can be prevented.

The coil for an internal combustion engine of the present invention is arranged such that an extended portion is disposed at one end of the second bobbin and the buffer coil is wound around the extended portion.

In the present invention, since the buffer coil is wound around the extended portion formed at one end of the second bobbin, an increase of the number of parts can be prevented.

The coil for an internal combustion engine of the present invention is arranged such that a pair of projections each having a C-shape are disposed at one end of the second bobbin, the buffer coil is locked to the pair of the projections and fixed to the second bobbin, and one end of the buffer coil is electrically connected to one end of the secondary coil through a junction.

In the present invention, the previously prepared buffer coil is engaged with and locked to the C-shaped projections formed at the one end of the second bobbin.

The ignition coil for an internal combustion engine according to the present invention comprises first and second non-magnetic bobbins into which a magnetic core is inserted, a primary coil composed of a wire wound around the first bobbin, a secondary coil composed of a wire wound around the second bobbin, an interrupting circuit connected to one end of the primary coil for interrupting a primary current flowing to the primary coil, an ignition plug connected to one end of the secondary coil for generating discharge spark by a secondary voltage output from the secondary coil, and a buffer coil connected in series with the primary coil and having an inductance smaller than that of the primary coil.

In the present invention, since the buffer coil is connected in series with to the primary coil, a capacitive discharge current is suppressed to thereby suppress radiant noise, radiation noise and line noise so that faulty operation of other circuit devices can be prevented.

The coil for an internal combustion engine of the present invention is arranged such that the buffer coil is formed of the same winding as that of the primary coil.

In the present invention, since the buffer coil is formed of the same winding as that of the primary coil, an increase of the number of parts can be prevented.

The coil for an internal combustion engine of the present invention is arranged such that an extended portion is disposed at one end of the first bobbin and the buffer coil is wound around the extended portion.

In the present invention, since the buffer coil is wound around the extended portion formed at one end of the first bobbin, an increase of the number of parts can be prevented.

The coil for an internal combustion engine of the present invention is arranged such that a pair of projections each having a C-shape are disposed at one end of the first bobbin, the buffer coil is locked to the pair of the projections and fixed to the first bobbin, and one end the buffer coil is electrically connected to one end of the primary coil through a junction.

In the present invention, the previously prepared buffer coil is engaged with and locked to the C-shaped projections formed at the one end of the first bobbin.

BRIEF DESCRIPTION OF THE DRAWINGS

FIG. 2(*b*) is a side elevational view thereof;

FIG. 3*a* through 3*d* are waveform diagrams for explaining the operation of the first embodiment of the present invention;

FIG. 4(*b*) is a side elevational view thereof;

FIG. 7(*b*) is a side elevational view thereof;

FIG. 8(*b*) is a side elevational view thereof;

FIG. 11*a* through 11*d* are waveform diagram explaining the operation of the conventional ignition coil for an internal combustion engine.

DESCRIPTION OF PREFERRED EMBODIMENTS

Embodiment 1

Figure 1:
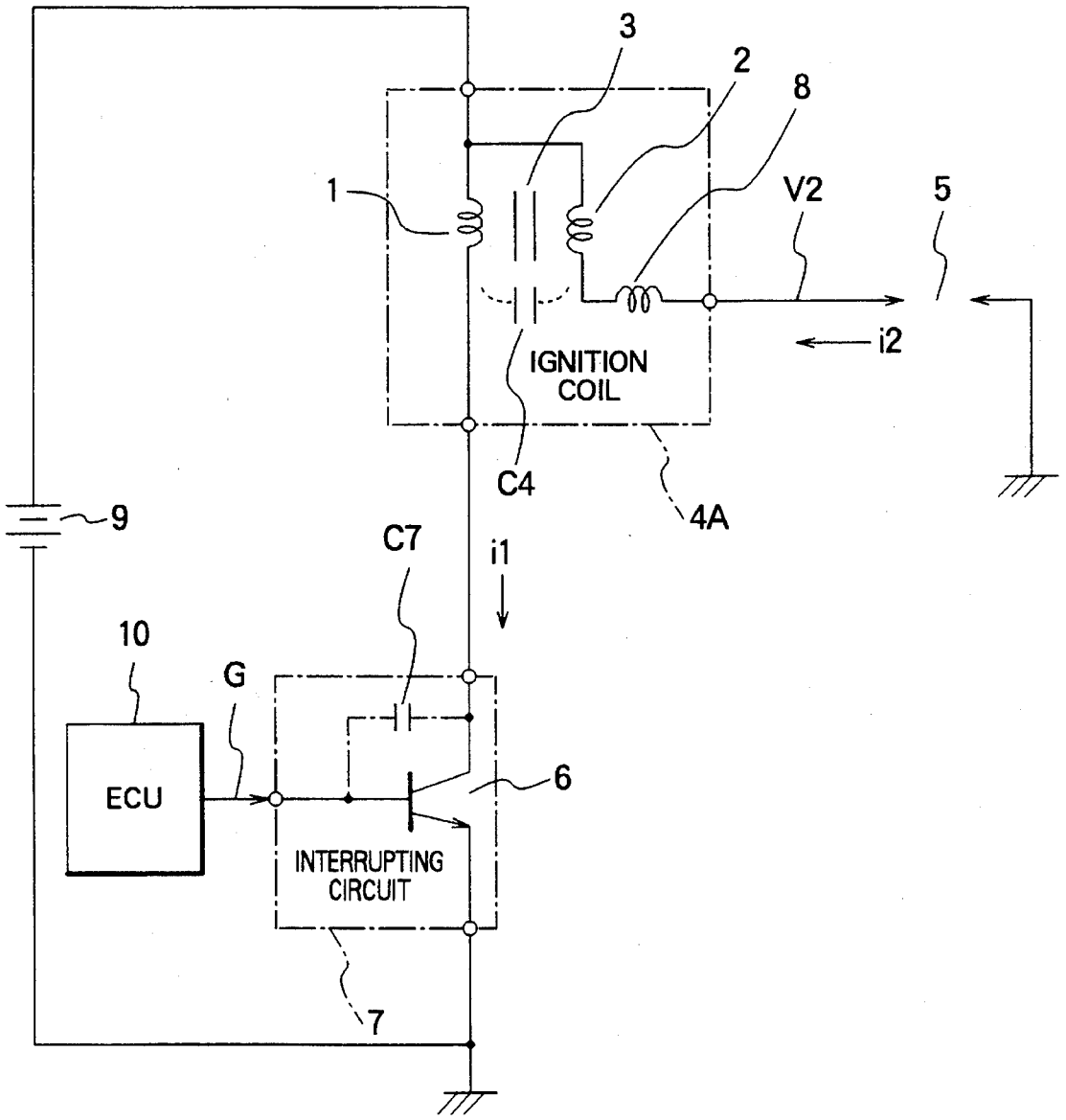
FIG. 1 is a schematic diagram showing a first embodiment of the present invention together with its associated circuits.

A first embodiment of the present invention will be described below with reference to the drawings. FIG. 1 is a schematic diagram showing the first embodiment of the present invention together with its associated circuits and FIGS. 2(*a*) and 2(*b*) are respectively a plan view and a side elevational view of a secondary coil 2 in FIG. 1 with its specific structure.

In the respective drawings, an ignition coil 4A includes a buffer coil 8 and the buffer coil 8 is connected in series with one end (output terminal side) of the secondary coil 2.

Figure 2A:
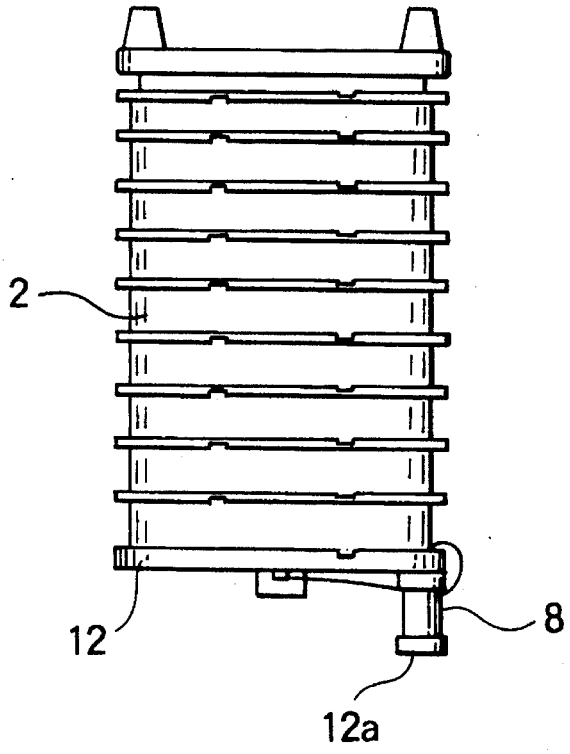
FIG. 2(*a*) is a plan view of a secondary coil and its associated parts according to the first embodiment of the present invention.
Figure 2B:
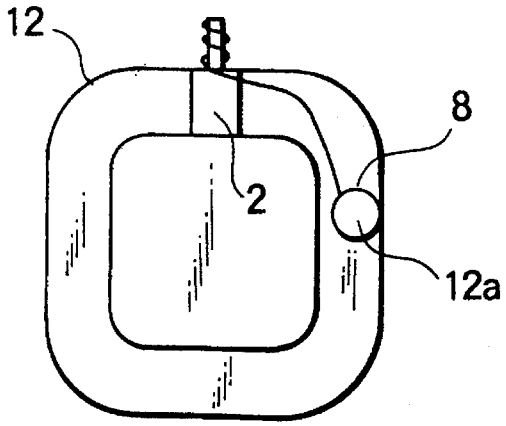

The buffer coil 8 has an inductance which is much smaller than that of the secondary coil 2 (for example, about a few percent or less of the inductance of the secondary coil 2) is and continuously formed of the same winding as that of the secondary coil 2. Further, as shown in FIGS. 2(*a*) and 2(*b*), an extended portion 12*a* is disposed at one end of a second bobbin 12 and the buffer coil 8 is wound around the extended portion 12*a*.

Note, the inductance of the buffer coil 8 is set to a value which does not injure a noise signal shut-off function and the intrinsic function of the ignition coil 4A.

Next, the operation of the first embodiment of the present invention shown in FIG. 1 and FIGS. 2(*a*), 2(*b*) will be described with reference to the waveform diagrams of FIG. 3. Note, the basic operation of the ignition coil 4A, an ignition plug 5 and a power transistor 6 is as described above.

First, when a high-tension secondary voltage V2 (FIG. 3*c*) is generated from the secondary coil 2 and discharging is started at the ignition plug 5, a large capacitive discharge current iC (FIG. 3*d*) which acts as a noise generating source flows.

At the time, the capacitive discharge current iC (noise signal) is made to a large current by a high-frequency peak value flowing from a floating capacitive component which is present from the ignition plug 5 up to the interior of the ignition coil 4A when the ignition plug 5 starts discharging, as described above.

However, since the buffer coil 8 is disposed at the one end of the secondary coil 2 (output side of the ignition coil 4A) as shown in FIG. 1 and FIGS. 2(*a*), 2(*b*), a passing-through frequency is reduced so that the peak value of the capacitive discharge current iC (corresponding to a noise signal) is reduced as shown in FIG. 3*d*.

In particular, since the buffer coil 8 is inserted between high-tension terminals for connecting the secondary coil 2 to the ignition plug 5, that is, to the passage of the capacitive discharge current iC in this case, the peak of the capacitive discharge current iC can be reduced.

Consequently, influence such as faulty operation and the like is not exerted by a noise signal superposed with circuit devices including the power transistor 6 and an ECU 10.

Further, since the buffer coil 8 is wound around the extended portion 12*a* formed at the one end of the second bobbin 12 integrally therewith, an increase of the number of parts can be suppressed and thus cost is not increased.

Embodiment 2

Note, although the extended portion 12*a* is formed on the second bobbin 12 and the buffer coil 8 is formed by winding the same wire as that of the secondary coil 2 around the extended portion 12*a* in the first embodiment, it is possible that a separate buffer coil 8 is previously prepared, fixed to one end of the second bobbin 12 and directly connected to the secondary coil 2.

Figure 4A:
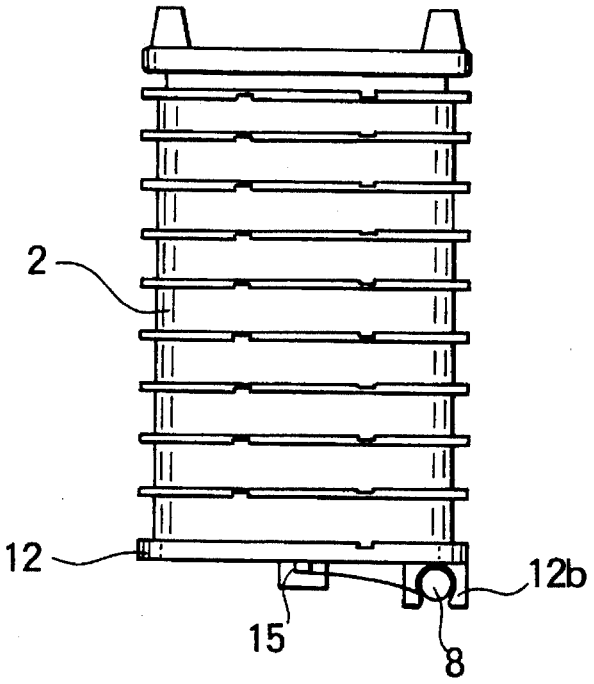
FIG. 4(*a*) is a plan view of a secondary coil and its associated parts according to a second embodiment of the present invention.
Figure 4B:
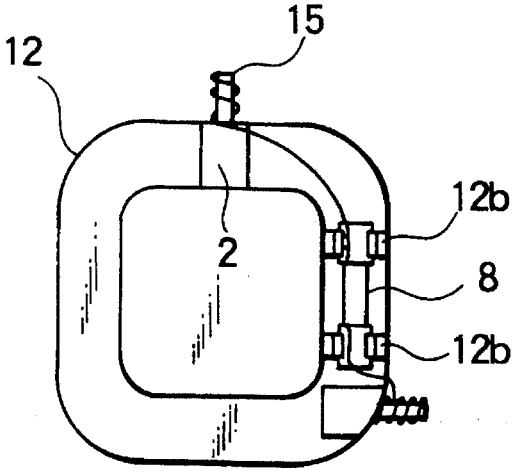

FIGS. 4(*a*) and 4(*b*) are respectively a plan view and a side elevational view of the secondary coil 2 and its associated parts according to a second embodiment of the present invention in which the buffer coil 8 is fixed to the second bobbin 12 after it is prepared. Note, the circuit arrangement of the second embodiment of the present invention is as shown in FIG. 1.

In this case, a pair of projections 12*b* each having a C-shape are formed at one end of the second bobbin 12.

The buffer coil 8 is previously and separately prepared and then engaged with and locked to the respective C-shaped portions of the pair of the projections 12*b* and fixed to the one end of the second bobbin 12.

One end of the buffer coil 8 is electrically connected to one end of the secondary coil 2 through a joint 15 made by welding, soldering or the like.

Although the number of manufacturing processes and parts is increased by separately preparing the buffer coil 8, the buffer coil 8 can be relatively easily made different from the case in which a difficult job of winding a wire around the extended portion 12*a* is required, and thus a manufacturing cost of the ignition coil as a whole can be reduced.

Embodiment 3

Note, although the above embodiments connect the buffer coil 8 in series with the output side of the secondary coil 2, the buffer coil 8 many be connected in series with a primary coil 1. That is, even if the buffer coil 8 is provided with the primary coil 1, preventing the superposition of noise with the upstream circuit of the ignition coil can be achieved to some degree.

A third embodiment of the present invention in which the buffer coil 8 is connected in series with the primary coil 1 will be described below with reference to the drawings. The arrangement of the third embodiment is the same as those of the first and second embodiments except that the buffer coil 8 is inserted with the primary coil 1.

Figure 5:
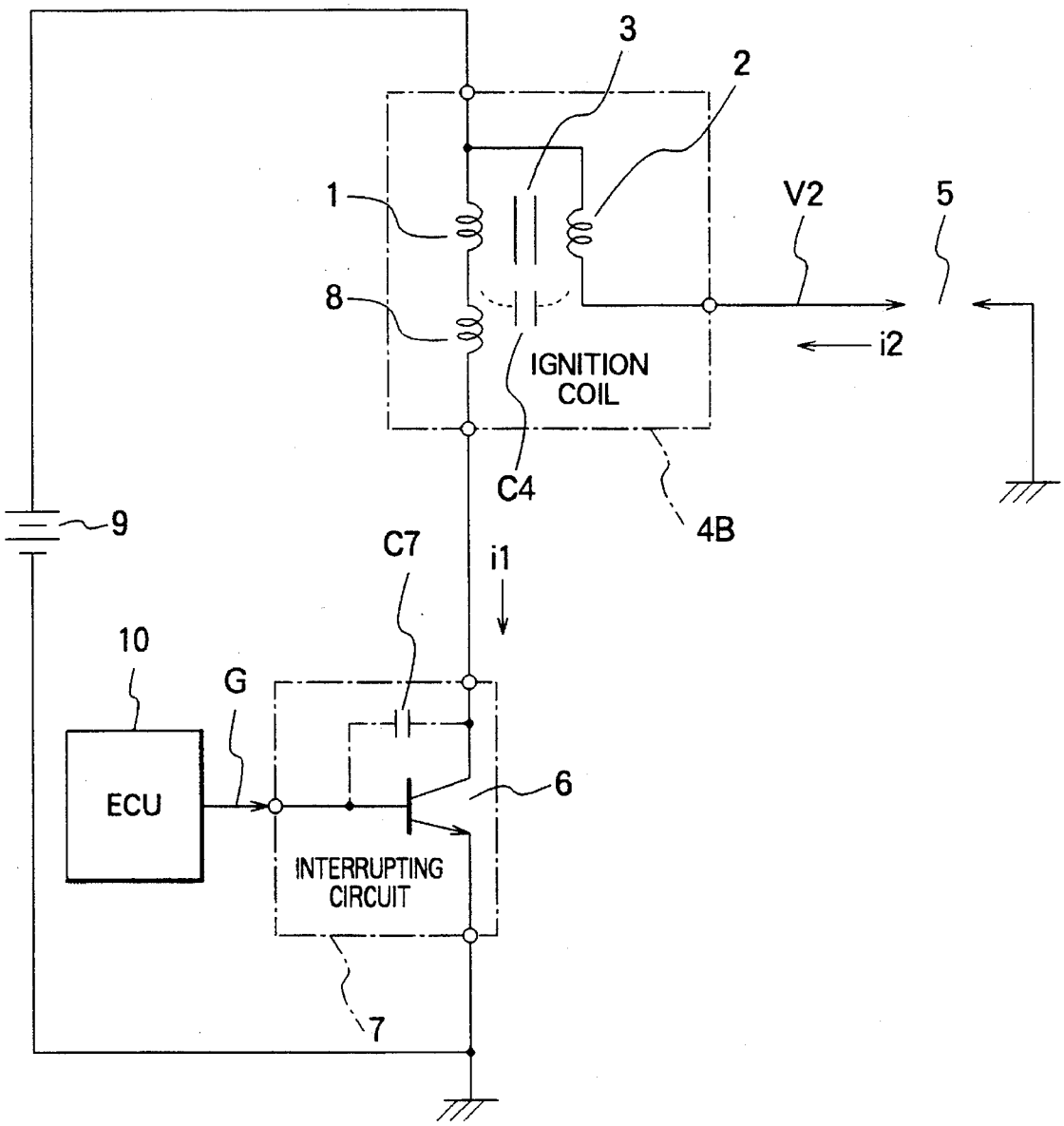
FIG. 5 is a schematic diagram showing a third embodiment of the present invention together with its associated circuits.
Figure 6:
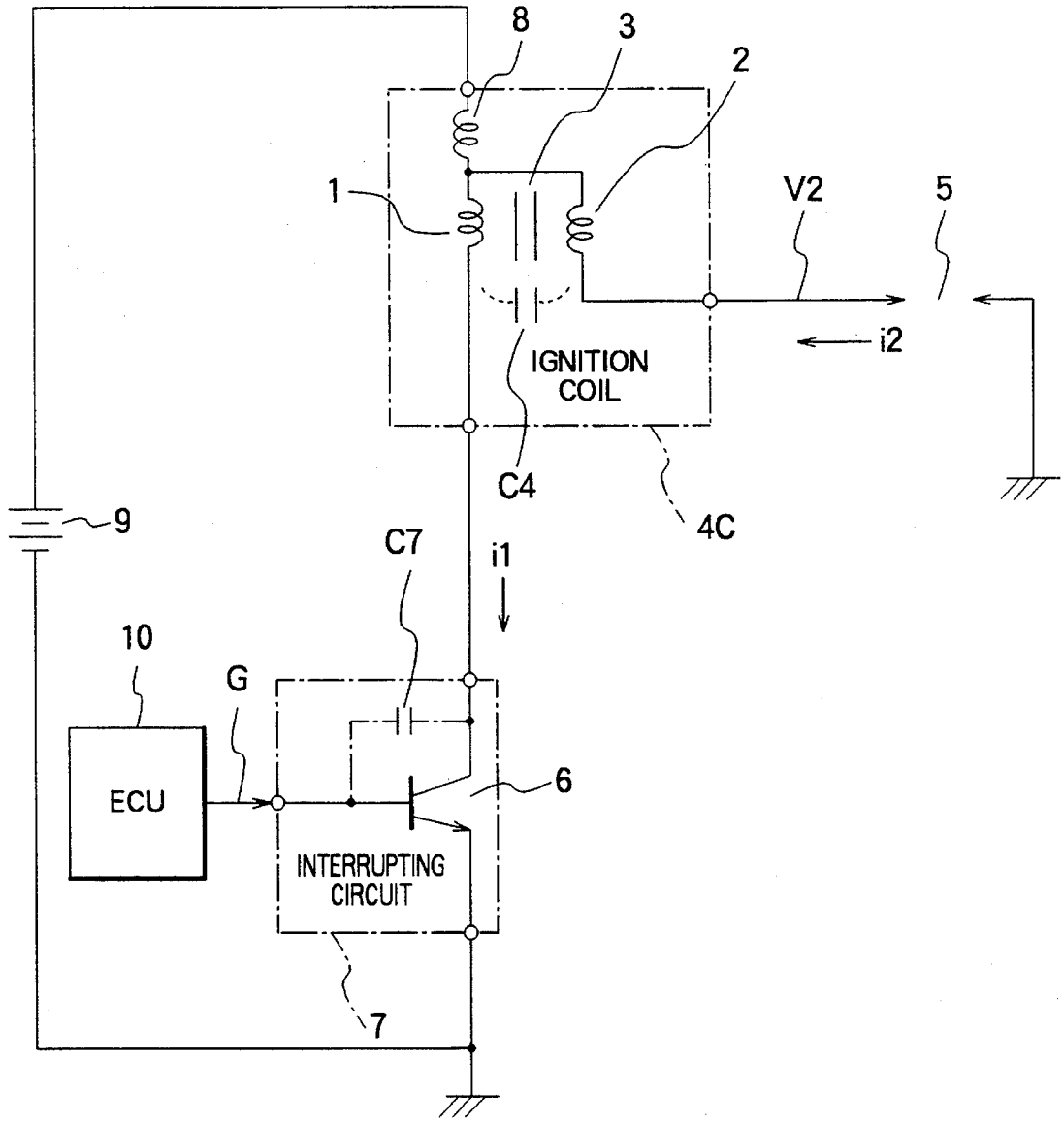
FIG. 6 is a schematic diagram showing another arrangement of the third embodiment of the present invention together with its associated circuits.

FIG. 5 and FIG. 6 are arrangement diagrams showing the third embodiment of the present invention together with its associated circuits, wherein FIG. 5 shows the case that the buffer coil 8 is inserted at the power transistor 6 side of the primary coil 1 and FIG. 6 shows the case that the buffer coil 8 is inserted at the power unit 9 side of the primary coil 1, respectively.

Figure 7A:
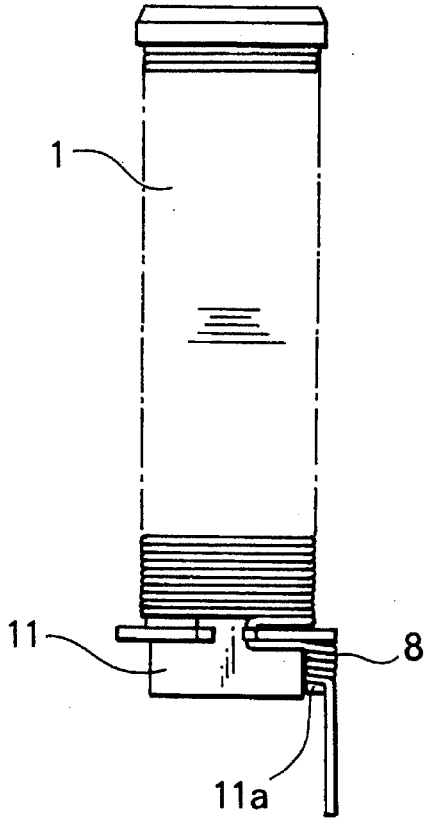
FIG. 7(*a*) is a plan view of a primary coil and its associated parts according to the third embodiment of the present invention.
Figure 7B:
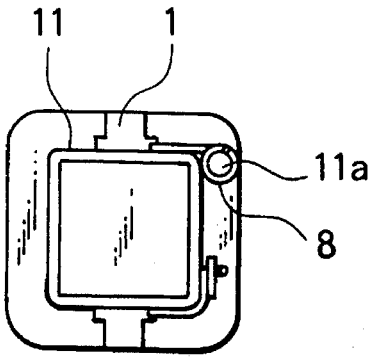

FIGS. 7(*a*) and 7(*b*) are respectively a plan view and a side elevational view showing specific structure of the primary coil 1 in FIG. 5 (or FIG. 6) and shows the case that an extended portion 11*a* is disposed on a first bobbin 11 and the buffer coil 8 is formed by winding the same winding as that of the primary coil 1 around the extended portion 11*a*.

Figure 8A:
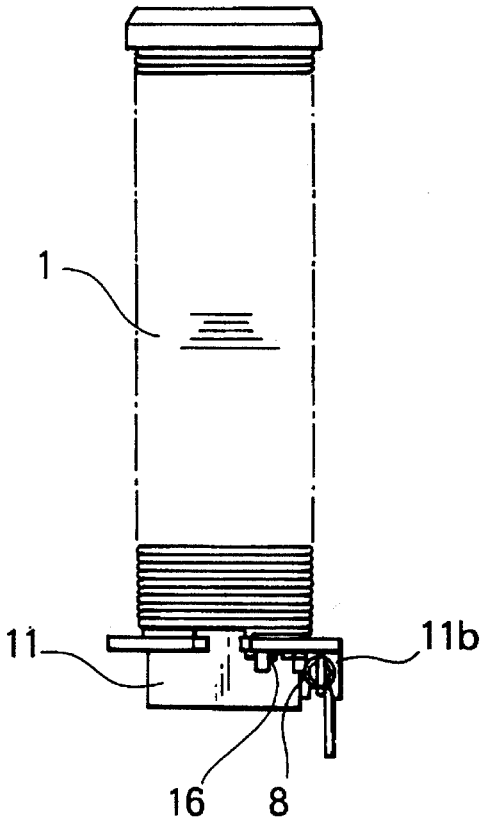
FIG. 8(*a*) is a plan view of the primary coil and its other associated parts according to the third embodiment of the present invention.
Figure 8B:
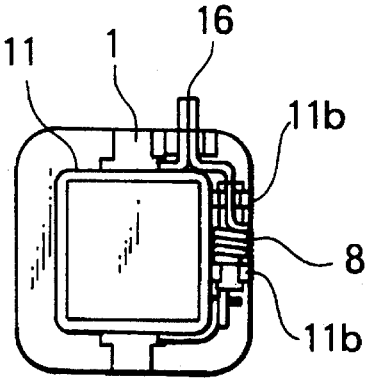
Figure 9:
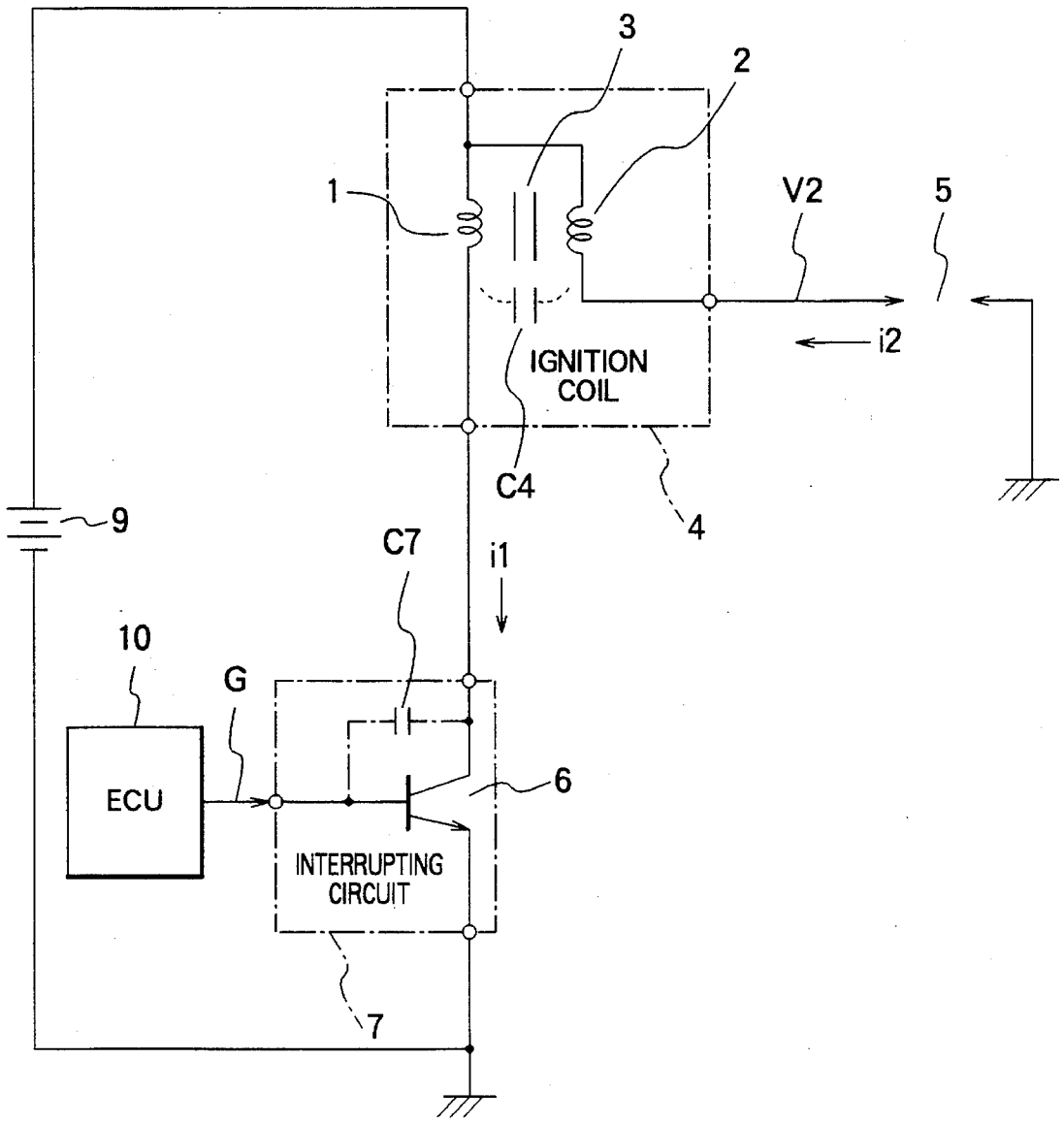
FIG. 9 PRIOR ART
FIG. 9 is a schematic diagram showing a conventional ignition coil for an internal combustion engine together with its associated circuits.
Figure 10:
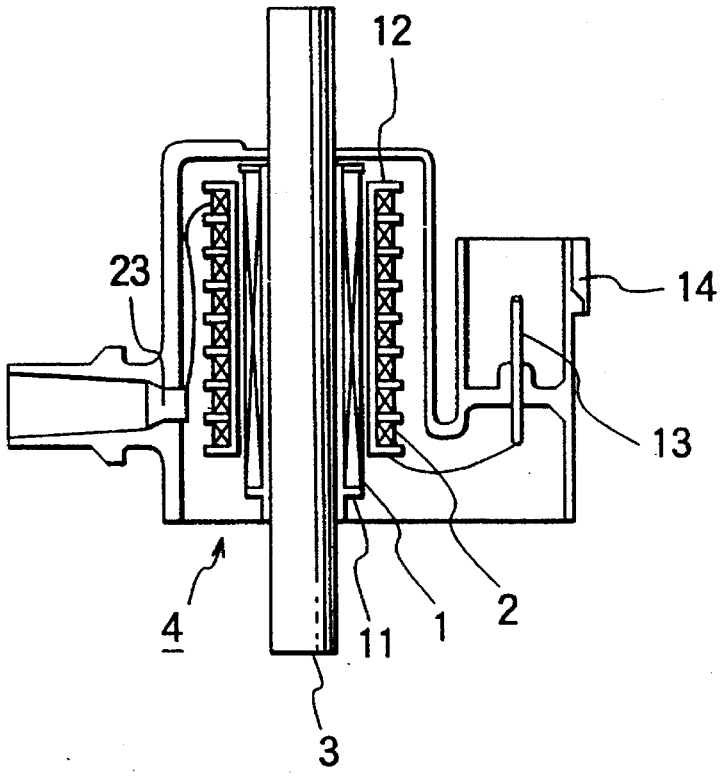
FIG. 10 PRIOR ART
FIG. 10 is a cross sectional view showing the structure of the conventional ignition coil for an internal combustion engine.

Further, FIGS. 8(*a*) and 8(*b*) are respectively a plan view and a side elevational view showing a specific structure of the primary coil 1 in FIG. 5 (or FIG. 6) and shows the case that a pair of projections 11*b* each having a C-shape are disposed on the first bobbin 11 and the separately prepared buffer coil 8 is locked to the projections 11*b* and fixed to the first bobbin 11.

In FIG. 5, an ignition coil 4B has the buffer coil 8 connected in series with one end (power transistor 6 side) of the primary coil 1, and in FIG. 6 and an ignition coil 4C has the buffer coil 8 connected in series with another end (power unit 9 side) of the primary coil 1.

In the cases of FIG. 5 and FIG. 6, the inductance of the buffer coil 8 is set to a value much smaller than that of the primary coil 1 (for example, a few percent or less of the inductance of the primary coil 1).

In FIGS. 7(*a*) and 7(*b*), the buffer coil 8 is continuously formed with the primary coil 1 by winding the same wire as that of the primary coil 1 around the extended portion 11*a* of the first bobbin 11.

Further, the buffer coil 8 is locked and fixed to the projected portion 11*b* of the first bobbin 11 after it is separately prepared and one end of the buffer coil 8 is electrically connected to one end of the primary coil 1 through a junction 16 in FIGS. 8(*a*) and 8(*b*).

Next, operation of the third embodiment of present invention shown in FIG. 5–FIGS. 8(*a*), 8(*b*) will be described with reference to the waveform diagrams of FIG. 3.

When the capacitive discharge current iC flows through the ignition plug 5 at the time of ignition control, a noise signal (current component) is induced in the primary coil 1 from the secondary coil 2 through the magnetic coupling component and the capacitive coupling component C4.

However, the buffer coil 8 connected in series with the one end of the primary coil 1suppresses the flowing-out of the current component induced in the primary coil 1 to the low-tension side (that is, the other circuit devices side including the power transistor 6 and ECU 10).

With this operation, line noise to be superposed with the low-tension line can-be reduced and the radiant noise and radiation noise from the ignition coils 4B and 4C to the circuit side can be reduced as well as the radiant noise and radiation noise from the low-tension line to the circuit side can be also reduced.

In particular, the above noise suppression effect is remarkably exhibited in ignition coils to which the ignition plug 5 is directly mounted and ignition coils accommodating the power transistor 6.

Further, when the buffer coil 8 is wound around the extended portion 11*a*, an increase of cost caused by an increase of the number of parts can be prevented as in the case of FIGS. 7(*a*), 7(*b*) and when the buffer coil 8 is locked and fixed to the C-shaped projection 11*b* as in the case of FIGS. 8(*a*), 8(*b*), manufacturing cost can be reduced because manufacturing processes can be made easy.

Embodiment 4

Note, although in the above embodiments a single buffer coil 8 is connected in series with any one of the primary coil 1 and secondary coil 2, the optional number of buffer coils may be connected in series with both the primary coil 1 and secondary coil 2 so long as they are located at positions which enable them to be connected in series.

Further, although these embodiments show that the present invention is applied to the ignition coils 4A–4C arranged such that the primary coil 1 and secondary coil 2 have a common connecting terminal on the power unit 9 side, the present invention is applicable to an ignition coil of another connection mode which is arranged such that, for example, both ends of the secondary coil constitute high-tension terminals and the former and latter cases achieve the same advantage.

What is claimed is:

1. An ignition coil for an internal combustion engine, comprising:

first and second non-magnetic bobbins into which a magnetic core is inserted;

a primary coil composed of a wire wound around said first bobbin;

a secondary coil composed of a wire wound around said second bobbin;

an interrupting circuit connected to one end of said primary coil for interrupting a primary current flowing to said primary coil;

an ignition plug connected to one end of said secondary coil for generating a discharge spark by a secondary voltage output from said secondary coil; and means for suppressing the superposition of a capacitive discharge noise signal generated by the ignition plug on the ignition coil, and the attendant adverse influence of said noise signal on the interrupting circuit, said suppressing means comprising a buffer coil connected in series with said secondary coil and having an inductance smaller than that of said secondary coil.

2. An ignition coil for an internal combustion engine according to claim 1, wherein said buffer coil is formed of the same winding as that of said secondary coil.

3. An ignition coil for an internal combustion engine according to claim 2, wherein an extended portion is disposed at one end of said second bobbin and said buffer coil is wound around said extended portion.

4. An ignition coil for an internal combustion engine according to claim 1, wherein:

a pair of projections each having a C-shape are disposed at one end of said second bobbin;

said buffer coil is locked to the pair of said projections and fixed to said second bobbin; and one end of said buffer coil is electrically connected to one end of said secondary coil through a junction.

5. An ignition coil for an internal combustion engine, comprising:

first and second non-magnetic bobbins into which a magnetic core is inserted;

a primary coil composed of a wire wound around said first bobbin;

a secondary coil composed of a wire wound around said second bobbin;

an interrupting circuit connected to one end of said primary coil for interrupting a primary current flowing to said primary coil;

an ignition plug connected to one end of said secondary coil for generating a discharge spark by a secondary voltage output from said secondary coil; and a buffer coil connected in series with said primary coil and having an inductance smaller than that of said primary coil, wherein said buffer coil is formed of the same winding as that of said primary coil.

6. An ignition coil for an internal combustion engine according to claim 5, wherein an extended portion is disposed at one end of said first bobbin and said buffer coil is wound around said extended portion.

7. An ignition coil for an internal combustion engine, comprising:

first and second non-magnetic bobbins into which a magnetic core is inserted;

a primary coil composed of a wire wound around said first bobbin;

a secondary coil composed of a wire wound around said second bobbin;

an interrupting circuit connected to one end of said primary coil for interrupting a primary current flowing to said primary coil;

an ignition plug connected to one end of said secondary coil for generating a discharge spark by a secondary voltage output from said secondary coil; and a buffer coil connected in series with said primary coil and having an inductance smaller than that of said primary coil, wherein:

a pair of projections each having a C-shape are disposed at one end of said first bobbin;

said buffer coil is locked to the pair of said projections and fixed to said first bobbin; and one end of said buffer coil is electrically connected to one end of said primary coil through a junction.

* * * * *